United States Patent [19]

Carver

[11] 4,039,715

[45] Aug. 2, 1977

[54] TEXTILE TREATING COMPOSITION AND TEXTILE YARN TREATED THEREWITH

[75] Inventor: Bobby C. Carver, Kingsport, Tenn.

[73] Assignee: Eastman Kodak Company, Rochester, N.Y.

[21] Appl. No.: 583,337

[22] Filed: June 2, 1975

Related U.S. Application Data

[62] Division of Ser. No. 392,726, Aug. 29, 1973, Pat. No. 3,907,689.

[51] Int. Cl.[2] ..... D02G 3/00; D06M 13/32

[52] U.S. Cl. ..... 428/375; 252/8.6; 252/8.7; 252/8.9; 428/394; 428/395

[58] Field of Search ..... 428/375, 378, 394, 395; 260/18 R, 28; 252/8.6, 8.77, 8.9

[56] References Cited

U.S. PATENT DOCUMENTS

| | | | |
|---|---|---|---|
| 2,344,671 | 3/1944 | Bertsch | 252/8.6 X |
| 2,838,455 | 6/1958 | Tompkins | 428/391 X |
| 2,842,462 | 7/1958 | Haas et al. | 252/8.6 X |
| 3,113,369 | 12/1963 | Barrett et al. | 252/8.8 X |
| 3,428,560 | 2/1969 | Olsen | 252/8.7 |
| 3,464,922 | 9/1969 | Bernholz et al. | 252/8.6 |

*Primary Examiner*—Lorraine T. Kendell

*Attorney, Agent, or Firm*—Clyde L. Tootle; Daniel B. Reece, III

[57] ABSTRACT

Textile treating compositions which are particularly adaptable for use on partially oriented textile yarn. These textile treating compositions contain a blend of organic esters which may also contain a wax, processing aids and blending agents. The blend of organic esters comprises a blend of alkylidyne trimethanol esters, and an effective amount of at least one member of the group of a diester of a dicarboxylic acid and an ethoxylated ester. The wax can be an ethoxylated fatty acid.

16 Claims, No Drawings

TEXTILE TREATING COMPOSITION AND TEXTILE YARN TREATED THEREWITH

This is a division of application Ser. No. 392,726 filed Aug. 29, 1973 now U.S. Pat. No. 3,907,689.

This invention relates to a new textile treating composition and textile articles treated therewith. More particularly, this invention concerns textile treating compositions and their use on synthetic textile fibers. In one specific aspect, this invention relates to a textile treating composition and the use of this composition on polyester multifilament partially oriented textile fiber.

Synthetic fibers formed from thermoplastic material such as polyester, nylon, acrylic, and the like are formed by extruding the molten polymer through a spinneret. The extruded fiber, either as a monofilament or multifilament fiber, requires further processing, such as drafting, at high temperatures to provide strength and elongation. Textile treating compositions are generally applied to the spun fibers to aid in the subsequent processing of the extruded fiber. These textile treating compositions generally contain an oil which acts as a lubricant for the fiber and decreases the friction of the fiber as it passes over processing equipment and prevents breaks in the fiber. The textile treating composition may also contain other additives such as antistat agents to prevent the accumulation of static electricity. The textile treating compositions are applied to the spun fiber almost immediately after the formation of the fiber. The textile treating composition must provide the necessary lubrication, be easy to apply and remove when desired, have good thermal and chemical stability, and not adversely affect the fiber.

It is, therefore, an object of the present invention to provide a novel textile treating composition.

Another object of this invention is to provide a novel textile treating composition particularly adaptable for use on the thermoplastic fiber.

One further object of the invention is to provide a textile treating composition which can be used on polyester fiber.

Another object of this invention is to provide a textile treating composition which is useful for processing partially oriented fiber.

Another and further object of the invention is to provide a textile treating composition which can be used on partially oriented polyester fiber.

A further object of the present invention is to provide a synthetic yarn having a textile treating composition thereon.

A still further object of this invention is a partially oriented polyester yarn having deposited thereon the novel textile treating composition, whereby said yarn can be draw textured to provide a yarn exhibiting uniform dyeability.

In accordance with this invention, a textile treating composition is provided for use on textile fibers formed from thermoplastic material. The textile treating composition comprises a blend of organic esters which may also contain a wax, antistat agents, and blending and emulsifying agents. The organic ester blend contains a major amount of alkylidyne trimethanol ester and an effective amount of at least one ester from the group consisting of diester of a dicarboxylic acid and an ethoxylated ester. The textile treating composition can be applied directly to the synthetic fiber, or a carrier or diluent, such as water, can be used and the textile treating composition applied to the fiber as an emulsion.

The textile treating compositions of the present invention are particularly useful in the manufacture of partially oriented polyester fibers. Partially oriented polyester fibers containing the textile treating compositions at low lubricant levels can be wound on packages at high speeds and maintain good package build relatively free from winding defects. The partially oriented polyester fiber can subsequently be draw-textured to produce yarn which is relatively free from short-term dye variations. Moreover, in processing the fiber containing the textile treating composition by draw-texturizing, less force is required to draft the fiber. Also, the accumulation of deposits on the draw-texturizing equipment is of an acceptable level. The textile treating composition also is substantially smoke free at the temperatures necessary for draw-texturing The blend of components which provides the lubricity to the textile treating composition is a blend of esters. The major component of this blend of esters is an alkylidyne trimethanol ester. Such alkylidyne trimethanol esters have the formula:

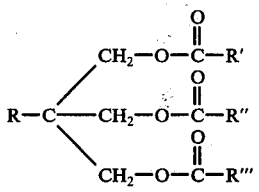

wherein R is hydrogen or an alkyl radical having 1 to 12 carbon atoms and R′, R″, and R‴ are selected from the class consisting of saturated and unsaturated alkyl radicals containing from 3 to 14 carbon atoms per radical. Such alkylidyne trimethanol esters include, for example: trimethylol propane trivalerate; trimethylol propane tricaproate; trimethylol propane tricaprylate; trimethylol propane tripelargonate; trimethylol propane tricaprate; trimethylol propane trilaurate; trimethylol propane trimyristate; trimethylol methane trivalerate; trimethylol methane tripelargonate; trimethylol methane trimyristate; trimethyol ethane trivalerate; trimethyol ethane tripelargonate; trimethylol ethane trimyristate; trimethylol butane trivalerate; trimethylol pentane trivalerate; trimethylol octane trivalerate; trimethylol dodecane trivalerate; trimethylol propane dicaprylate valerate; trimethylol propane valerate caproate capeate; and the like.

In addition to an alkylidyne trimethanol ester, the blend of components contains an effective amount of at least one member of the group consisting of a diester of a dicarboxylic acid and an ethoxylated ester. Such diesters of a dicarboxylic acid have the formula

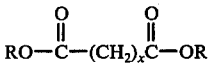

wherein $x$ is 2 to 22 and R is an alkyl radical containing 2 to 22 carbon atoms. Such diesters of dicarboxylic acid include, for example: diethyl succinate; diethyl glutarate; diethyl adipate; diethyl pimelate; diethyl suberate; diethyl azelate; diethyl sebacate; diethyl brassylate; dipropyl succinate; dibutyl succinate; dipentyl succinate; dihexyl succinate; dioctyl succinate; dioctyl glutarate; dioctyl adipate; dioctyl pimelate; dioctyl suberate;

dioctyl azelate; dioctyl sebacate; dioctyl brassylate; dilauryl succinate; dimyristyl succinate; dicetyl succinate; dioctyldocyl succinate; dibehenyl succinate and the like.

Such ethoxylated esters have the formula $$CH_3-(CH_2)_x\overset{\overset{\displaystyle O}{\|}}{C}-O-(CH_2CH_2-O)_y\overset{\overset{\displaystyle O}{\|}}{C}-(CH_2)_xCH_3$$

wherein $x$ is 4 to 22 and y is 1 to 40. Such ethoxylated esters include, for example: POE (1) dicaporoate, POE (2) dicaprylate, POE (3) dipelargonate, POE (4) dicaprate, POE (5) dilaurate, POE (6) dimyristate, POE (7) dipalmitate, POE (8) distearate, POE (9) dicaproate, POE (9) dicaprylate, POE (9) dipelargonate, POE (9) dicaprate, POE (9) dilaurate, POE (9) dimyristate, POE (9) dipalmitate, POE (9) distearate, POE (9) dibehenate, POE (12) dicaproate, POE (24) dicaprylate, POE (40) dilaurate and the like.

As noted hereinabove, the major portion of the lubricating portion of the composition is the alkylidyne trimethanol ester. The alkylidyne trimethanol ester is present in the blend in an amount of about 5 to 40 weight percent. The preferred amount of alkylidyne trimethanol ester present in the blend is about 10 to 40 weight precent with 20 weight percent being more preferred and 19.1 being most preferred.

The diester of a dicarboxylic acid is present in the blend in an amount of about 1 to 15 weight percent with 5 to 10 weight percent being preferred, 7 weight percent being more preferred and 6.9 weight percent being most preferred.

The ethoxylated esters are present in an amount of 1 to 15 weight percent with 2 to 5 weight percent being preferred, 4 weight percent being more preferred and 3.8 weight percent being most preferred.

A wax can be added to the blend of organic esters. The wax, in addition to other advances, improves the viscosity of the textile treating composition. The wax may also act as a lubricating component. The wax has a melting point greater than 100° F. Such waxes include, for example, ethoxylated fatty acid having the formula $$CH_3(CH_2)_x-\overset{\overset{\displaystyle O}{\|}}{C}-(OCH_2H_4)_y-OH$$

wherein $x$ is 10 to 22 and $y$ is 5 to 200. Such ethoxylated fatty acids are, for example, POE (5) laurate, POE (10) myristate, POE (16) palmitate, POE (20) stearate, POE (40) laurate, POE (40) myristate, POE (40) palmitate, POE (40) stearate, POE (40) behenate, POE (80) laurate, POE (120) myristate, POE (160) palmitate, POE (200) stearate and the like.

The textile treating composition can also contain at least one processing aid selected from the group of (1) an alkali metal salt of a phosphoric acid mono- or diester of an ethylene oxide adduct of at least one member selected from the group consisting of a $C_8$ to $C_{18}$ linear alkyl alcohol and (2) an alkali metal salt of sulfated fatty alcohols containing 12 to 22 carbon atoms. Such alkali metal salts of a phosphoric acid mono- or diester of an ethylene oxide adduct of at least one member selected from the group consisting of a $C_8$ to $C_{18}$ linear alkyl alcohol are, for example: POE (3) octyl potassium phosphate, POE (2) decyl potassium phosphate, POE (4) lauryl potassium phosphate, POE (5) octyl potassium phosphate, POE (5) decyl potassium phosphate, POE (5) lauryl potassium phosphate, POE (5) myristyl potassium phosphate, POE (5) cetyl potassium phosphate, POE (5) stearyl potassium phosphate, POE (10) octyl potassium phosphate, POE (12) decyl potassium phosphate, POE (16) lauryl potassium phosphate, POE (18) stearyl potassium phosphate, POE (20) octyl potassium phosphate, POE (25) cetyl potassium phosphate and the like.

Such alkali metal salts of sulfated fatty alcohols containing 12 to 22 carbon atoms are for example: sodium lauryl sulfate, potassium lauryl sulfate, cesium lauryl sulfate, sodium myristyl sulfate, sodium cetyl sulfate, sodium stearyl sulfate, sodium behenyl sulfate and the like.

The textile treating composition can also contain at least one blending agent of the group consisting of (1) an ethoxylated alcohol; (2) an ethoxylated castor oil ether containing from about 5 to about 200 moles of ethylene oxide per mole of castor oil; (3) an ethoxylated polyoxpropylene; (4) an ethoxylated aromatic phenol ether and (5) an aliphatic saturated or unsaturated alcohol containing 10 to 30 carbon atoms.

The ethoxylated alcohols useful as blending agents have the formula $$CH_3(CH_2)_x(OCH_2CH_2)_n OH$$

wherein $x$ is 8 to 22 and $n$ is 1 to 20. Such ethoxylated alcohols are, for example: POE (5) decyl alcohol; POE (5) lauryl alcohol; POE (5) myristyl alcohol; POE (5) stearyl alcohol; POE (5) cetyl alcohol; POE (5) behenyl alcohol; and the like.

The ethoxylated castor oil ether containing from 5 to 200 moles of ethylene oxide per mole of castor oil useful as blending agents are, for example: POE (5) castor oil; POE (30) castor oil; POE (75) castor oil; POE (150) castor oil; POE (200) castor oil; and the like.

The ethoxylated polyoxypropylenes useful as blending agents have the formula $$H(OCH_2CH_2)_x O\left(\underset{\displaystyle CH_3}{\underset{|}{CH}}-CH_2-O\right)_y(CH_2CH_2-O)_z H$$

wherein $x$ is 1 to 15, $y$ is 1 to 50, and $z$ is 1 to 15. Such ethoxylated polyoxypropylenes are, for example, the family of compounds sold by Wyandotte Chemical Corporation under the trademark "Pluronic". Such useful blending agents are Pluronic L-42, Pluronic L-61, Pluronic L-62, Pluronic L-63, Pluronic L-71, Pluronic L-72, Pluronic L-73, Pluronic L-81, Pluronic L-82, Pluronic L-83, Pluronic L-41, Pluronic L-43, Pluronic L-51, and Pluronic L-52. The term "Pluronic" designates that the chemical has the general chemical structure shown above. The "L-" part of the code designates that the product is liquid. The first digit (or first two digits) of the number designates the degree of propoxylation of the backbone structure (Y value), while the last digit (times 10) designates the weight percent of the overall product which is ethylene oxide (X and Z values).

The ethoxylated aromatic phenols useful as blending agents have the formula

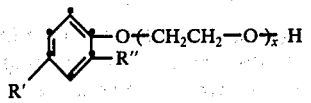

wherein R′ and R″ are aryl, substituted aryl, alkyl aryl, alkyl substituted aryl, and $x$ is 1 to 25. Such ethoxylated aromatic phenols are, for example: POE (6) dibenzyl phenol ether; POE (6) diphenyl phenol ether; and the like.

The aliphatic saturated or unsaturated alcohols containing 10 to 30 carbon atoms useful as blending agents are, for example: decenoyl alcohol; tetradecenoyl alcohol; hexadecenoyl alcohol; octadecenoyl alcohol (oleyl alcohol when cis-9 octadecenoyl alcohol); behenyl alcohol; and the like.

The textile treating composition can be prepared by blending the components together. All the components except the wax have a melting point less than 100° F. and most are liquid at normal room temperature. The components which are liquid at room temperature can be blended together and the wax heated above its melting point and gradually added to the blend of the other component or the blend can be heated and the wax added to the heated liquid blend. However, it is preferred that the textile treating composition be prepared by mixing together an ethoxylated alcohol and an alkali metal salt of a phosphoric acid mono- or diester of an ethylene oxide adduct of at least one member selected from the group consisting of a $C_8$ to $C_{18}$ linear alkyl alcohol. This blend is then neutralized with 25% potassium hydroxide to a pH of about 7.8 to 8.1. A blend formed from all the other components, except the wax, is then blended with the neutralized blend. The wax is then added, by heating, to this blend to form the novel textile treating compositions of the present invention. A preferred method of addition of the wax to the blend of other components is to add the wax with heating to water which is then used to prepare an emulsion. For example, the wax is added to the required amount of water. Then the other components are added to the wax/water mixture. This textile treating composition is storage stable and can be stored at room temperature for periods of several days without emulsion breakdown.

The textile treating composition can be applied directly to the fiber or can be applied with a carrier, such as water, in emulsion form. Aqueous emulsions can be prepared at any ratio of oil to water. Emulsions containing from 1 to 30 weight percent of the textile treating composition are preferred with emulsions containing about 13 to 17 weight percent being most preferred.

The textile treating composition is normally applied to the yarn soon after the yarn exits from the spinning cabinet and prior to its being wound on a package. The textile treating composition can be applied as a spray, or by any other means. A preferred method is to apply the composition by passing the yarn over a pair of rotating finish rolls. The finish rolls are normally located ahead of the godet rolls, but they could be located between or after the godet rolls. The yarn contact with the finish rolls is controlled by guides which are located before and after each roll. Very light contact with the finish roll is preferred. While finish rolls commonly used in the trade are generally made of aluminum oxide type materials, other materials such as metal rolls and flame coated rolls could be used. Two finish rolls are preferred in most cases; however, finishes have been successfully applied with one roll. More than two rolls could be used but they would be expensive and they are thought to be unnecessary. Methods other than rotating rolls can be used to apply the finish to the yarn. Yarn finishes can be applied by immersion, wicking devices, and sprays or other atomizing type devices.

When using rotating finish rolls to apply finish to a yarn from an emulsion, the amount of finish applied will depend on the yarn speed, contact angle with the roll, finish roll speed, yarn size, and filament count and the percent of oil in the emulsion. The preferred level of oil in the emulsion is between 10% and 20%. It is felt that a straight oil would work if a satisfactory method of applying it could be devised. Solutions of oil in organic solvents could be used as long as the solvent has no adverse effect on the yarns.

The preferred finish level is from 0.40% to 0.70%; however, yarns having 0.3% to 1.0% have been used. Higher levels could be used but it would cost more and it is expected that the deposit build-up on the draw texturing equipment would be greater than at the preferred level.

The textile treating compositions of the present invention provide yarn frictional properties which are suitable for both winding and draw-texturing. Yarns with these finishes have performed well in draw-texturing, as evidenced by threadline tensions, low deposit build-up on equipment and by the acceptable properties and uniform dyeing of the textured yarns.

This invention will be further illustrated by the following examples although it will be understood that these examples are included merely for purposes of illustration and are not intended to limit the scope of the invention.

EXAMPLE 1

The following components are blended and treated in a preferred manner to optimize the stability of both the oil and oil-in-water emulsion. The eleven components and their weight percentage in the oil are listed below:

| Component Number | Component Chemical Name | Weight Percent |
|---|---|---|
| 1 | POE (5) stearyl ether | 9.1 |
| 2 | POE (5) lauryl potassium phosphate (contains 9 to 13 weight percent water) | 5.4 |
| 3 | POE (30) castor oil ether | 3.8 |
| 4 | PEG (MW=400) dilaurate | 3.8 |
| 5 | Sodium lauryl sulfate (contains 58 to 62 weight percent water) | 9.1 |
| 6 | Ethoxylated polyoxypropylene | 11.4 |
| 7 | POE (6) benzyl phenyl phenol | 7.6 |
| 8 | Dioctyl sebacate | 6.9 |
| 9 | Trimethylol propane tri—$C_8$—C—$_{10}$ acid | 19.1 |
| 10 | Oleyl alcohol | 3.8 |
| 11 | POE (40) stearate | 20.0 |

A. Method of Preparation of Oil

1. Mix component (1) and (2) in a suitable container and warm to 70°–80° C. Adjust the pH of the resulting solution to a value of 7.8–8.1 using a 25% KOH solution. Determine the pH of the above mixture on a 1 weight percent aqueous solution.

2. Mix components (3), (4), (5), (6), (7), (8), (9), and (10) in a separate container with sufficient agitation to ensure mixing. Heating of the mixture is not necessary.

3. Combine the solution prepared in Step (1) and Step (2). The order of combining is not important. This homogeneous oil blend is now stored for later use in preparing the textile treating compositions of the present invention.

Preparation of Stable Textile Treating Compositions from Oil

1. Dissolve the correct amount of component (11) in the correct amount of water in the finish preparation tank.

2. Add the correct amount of oil previously prepared as described above to the wax/water solution. Moderate agitation should be used in all mixing operations to ensure uniform blending.

EXAMPLE 2

Example 1 is repeated except that the blend of POE (5) stearyl ether and POE (5) lauryl potassium phosphate are not neutralized as described in Step 1 of Part A. The stability of the resulting oil and emulsion might not be satisfactory. The oil blend, if not properly neutralized, will become cloudy on storage and emulsion prepared with this cloudy oil blend tends to separate out on storage and be undesirable for use as textile treating compositions for use in production.

EXAMPLE 3

Example 1 is repeated except that the POE (40) stearate [Component (11)] is blended with the other components in the oil prior to preparation of the emulsion. The emulsion prepared from such a blend of oil and wax is not as storage stable as the emulsions prepared according to the process of Example 1. Emulsions prepared in this manner tend to become cloudy faster than emulsions prepared as described in Example 1. While these cloudy emulsions are useful as textile treating compositions, the cloudy condition indicates that the emulsion is starting to break down. For this reason stable water clear emulsions are preferred.

EXAMPLE 4

Example 1 is repeated except that the POE (40) stearate wax is not added to the textile lubricant composition.

EXAMPLE 5

The textile treating composition of Example 1 is applied to a partially oriented polyethylene terephthalate filament yarn in an amount of from 0.4 to 0.6 percent textile treating composition based on the weight of the fiber.

The partially oriented polyethylene terephthalate filament yarn containing the textile treating composition is sequentially draw-texture over a heater plate at a temperature of 110° C. to provide a draw-textured yarn. A sock was knitted from this yarn and dyed Copen Blue. These dyed socks had acceptable short-term dye uniformity. Socks knitted from yarn samples which were simultaneously draw-textured also had acceptable short-term dye uniformity.

In drafting the partially oriented fiber, it was also noted that there was not an unusual amount of residue build-up on the heater plates and spindles. Also, there was no excessive smoking in the draw texturizing operation.

EXAMPLE 6

The textile treating composition of Example 4 is applied to a partially oriented yarn according to Example 5. The socks which were knitted from the draw textured simultaneous yarn had unacceptable short-term end-to-end dye variation. Also, more force is required to draw texture this yarn as compared with the yarn of Example 5.

The textile treating compositions of the present invention provide the art with lubricants which can be used to prepare fully drawn or partially oriented thermoplastic yarns, such as nylon and polyester. The partially oriented yarn can be draw texturized, either simultaneously or sequentially, to provide full drawn yarn having consistent dye uniformity. The lubricants can be processed satisfactorily on conventional textile equipment without excessive build-up of deposits on heated surfaces and spindles. These improved textile compositions also have low volatility and do not provide an excessive amount of smoking. Also, yarn having these textile treating compositions can be draw textured with less force required to draw the yarn.

Although the invention has been described in considerable detail with particular reference to certain preferred embodiments thereof, variations and modifications can be effected within the spirit and scope of the invention.

I claim:

1. Textile yarn comprising a partially oriented thermoplastic fiber having on the surface thereof a textile treating composition which comprises a blend containing:

a. a major amount of an alkylidyne trimethanol ester having the formula

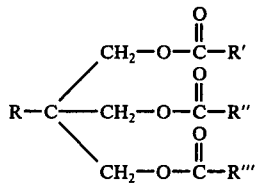

wherein R is H or an alkyl radical having 1 to 12 carbon atoms and R′, R″, and R‴ are selected from the class consisting of saturated alkyl radicals and alkenyl radicals containing from 4 to 14 carbon atoms per radical; and b. a minor effective amount of at least one member selected from the group consisting of a diester of a dicarboxylic acid having the structure

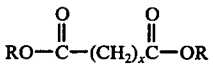

wherein $x$ is 2 to 22 and R is an alkyl radical containing 2 to 22 carbon atoms and an ethoxylated ester of the formula

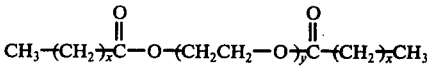

wherein $x$ is 4 to 22 and $y$ is 1 to 40; (*a*) being present in an amount of about 10 to 40 weight percent of said composition and (*b*) being present in an amount of about 1 to 15 weight percent of said composition; and c. about 10 to 30 weight percent of an ethoxylated fatty acid wax which has a melting point greater than 100° F. and having the formula $$CH_3(CH_2)_x-\overset{O}{\overset{\|}{C}}-(OCH_2CH_2)_y-OH$$

wherein $x$ is 10 to 22 and $y$ is 5 to 200; and d. about 10 to 20 weight percent of at least one processing aid selected from the group consisting of 1. an alkali metal salt of a phosphoric acid mono or diester of an ethylene oxide adduct of at least one member selected from the group consisting of a $C_8$ to $C_{18}$ linear alkyl alcohol which contains 2 to 25 moles of ethylene oxide; and
2. an alkali metal salt of sulfated fatty alcohols containing 12 to 22 carbon atoms; and e. about 25 to 45 weight percent of at least one blending agent of the group consisting of 1. an ethoxylated alcohol having the formula $$CH_3-(CH_2)_x-(OCH_2CH_2)_n-OH$$

wherein $x$ is from 8 to 22 and $n$ is 1 to 20;

2. an ethoxylated castor oil ether containing from about 5 to about 200 moles of etylene oxide per mole of castor oil;
3. an ethoxylated polyoxypropylene having the formula $$H-(OCH_2CH_2)_x-O-(\underset{\underset{CH_3}{|}}{CH}-CH_2-O)_y-(CH_2CH_2O)_z-H$$

wherein $x$ is 1 to 15, $y$ is 1 to 50, and $z$ is 1 to 15;

4. an ethoxylated aromatic phenol ether having the formula

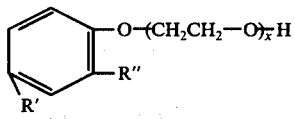

wherein R′ and R″ are aryl, alkyl aryl, and $x$ is 1 to 25; and 5. an aliphatic saturated or unsaturated unsubstituted alcohol containing 10 to 30 carbon atoms.

2. Textile yarn comprising a partially oriented thermoplastic fiber having on the surface thereof a textile treating composition which comprises:

a. about 20 to 40 weight percent of a blend containing 1. a major amount of an alkylidyne trimethanol ester having the formula

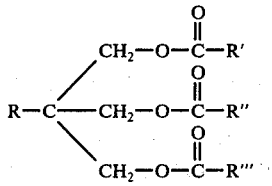

wherein R is H or an alkyl radical having 1 to 12 carbon atoms and R′, R″, and R‴ are selected from the class consisting of saturated alkyl radicals and alkenyl radicals containing from 4 to 14 carbon atoms per radical; and 2. a minor effective amount of at least one member selected from the group consisting of a diester of a dicarboxylic acid having the structure $$RO-\overset{O}{\overset{\|}{C}}-(CH_2)_x\overset{O}{\overset{\|}{C}}-OR$$

wherein $x$ is 2 to 22 and R is an alkyl radical containing 2 to 22 carbon atoms and an ethoxylated ester of the formula $$CH_3-(CH_2)_x\overset{O}{\overset{\|}{C}}-O-(CH_2-CH_2O)_y\overset{O}{\overset{\|}{C}}-(CH_2)_xCH_3$$

wherein $x$ is 4 to 22 and $y$ is 1 to 40; (1) being present in an amount of about 10 to 40 weight percent of said composition and (2) being present in an amount of about 1 to 15 weight percent of said composition;

b. about 10 to 30 weight percent of an ethoxylated fatty acid wax which has a melting point greater than 100° F. and having the formula $$CH_3(CH_2)_x-\overset{O}{\overset{\|}{C}}-(OCH_2CH_2)_y-OH$$

wherein $x$ is 10 to 22 and $y$ is 5 to 200;

c. about 10 to 20 weight percent of at least one processing aid selected from the group consisting of 1. an alkali metal salt of a phosphoric acid mono- or diester of an ethylene oxide adduct of at least one member selected from the group consisting of a $C_8$ to $C_{18}$ linear alkyl alcohol which contains 2 to 25 moles of ethylene oxide; and
2. an alkali metal salt of sulfated fatty alcohols containing 12 to 22 carbon atoms; and d. about 25 to 45 weight percent of at least one blending agent of the group consisting of 1. an ethoxylated alcohol having the formula $$C_3-(CH_2)_x-(OCH_2CH_2)_n-OH$$

wherein $x$ is from 8 to 22 and $n$ is 1 to 20;

2. an ethoxylated castor oil ether containing from about 5 to about 200 moles of ethylene oxide per mole of castor oil;
3. an ethoxylated polyoxypropylene having the formula $$H-(OCH_2CH_2)_x-O-\left(\underset{\underset{CH_3}{|}}{CH}-CH_2-O\right)_y-(CH_2CH_2-O)_z-H$$

wherein $x$ is 1 to 15, $y$ is 1 to 50, and $z$ is 1 to 15;

4. an ethoxylated aromatic phenol ether having the formula

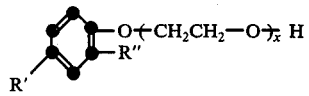

wherein R′ and R″ are aryl, substituted aryl, alkyl aryl, alkyl substituted aryl, and $x$ is 1 to 25; and 5. an aliphatic saturated or unsaturated alcohol containing 10 to 30 carbon atoms.

3. Continuous filament textile yarn comprising a partially oriented thermoplastic fiber having on the surface thereof a textile treating composition which comprises:

a. about 30 weight percent of a blend containing 1. at least 50 weight percent of an alkylidyne trimethanol ester having the formula

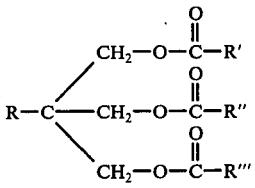

wherein R is H or an alkyl radical having 1 to 12 carbon atoms and R′, R″, and R‴ are selected from the class consisting of saturated alkyl radicals and alkenyl radicals containing from 4 to 14 carbon atoms per radical; and 2. an effective amount of at least one member selected from the group consisting of a diester of a dicarboxylic acid having the structure

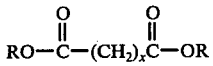

wherein $x$ is 2 to 22 and R is an alkyl radical containing 2 to 22 carbon atoms and an ethoxylated ester of the formula

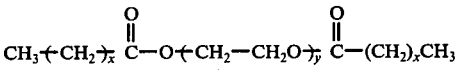

wherein $x$ is 4 to 22 and $y$ is 1 to 40;

b. about 20 weight percent of an ethoxylated fatty acid wax which has a melting point greater than 100° F., and having the formula

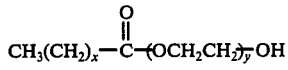

wherein $x$ is 10 to 22 and $y$ is 5 to 200; and c. about 15 weight percent of at least one processing aid selected from the group consisting of 1. an alkali metal salt of a phosphoric acid mono- or diester of an ethylene oxide adduct of at least one member selected from the group consisting of a $C_8$ to $C_{18}$ linear alkyl alcohol which contains 2 to 25 moles of ethylene oxide; and 2. an alkali metal salt of sulfated fatty alcohols containing 12 to 22 carbon atoms; and d. about 35 weight percent of at least one blending agent of the group consisting of 1. an ethoxylated alcohol having the formula

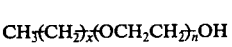

wherein $x$ is from 8 to 22 and $n$ is 1 to 20;

2. an ethoxylated castor oil ether containing from about 5 to about 200 moles of ethylene oxide per mole of castor oil;

3. an ethoxylated polyoxypropylene having the formula

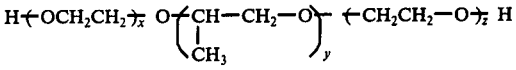

wherein $x$ is 1 to 15, $y$ is 1 to 50, and $z$ is 1 to 15;

4. an ethoxylated aromatic phenol ether having the formula

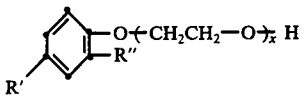

wherein R′ and R″ are aryl, substituted aryl, alkyl aryl, alkyl substituted aryl, and $x$ is 1 to 25; and 5. an aliphatic saturated or unsaturated alcohol containing 10 to 30 carbon atoms.

4. Continuous filament textile yarn comprising a partially oriented thermoplastic fiber having on the surface thereof a textile treating composition which comprises:

a. about 30 weight percent of a blend containing 1. about 19 weight percent of an alkylidyne trimethanol ester having the formula

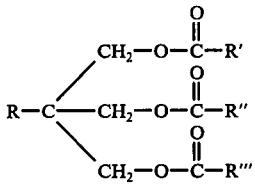

wherein R is H or an alkyl radical having 1 to 12 carbon atoms and R′, R″, and R‴ are selected from the class consisting of saturated alkyl radicals and alkenyl radicals containing from 4 to 14 carbon atoms per radical;

2. about 7 weight percent of a diester of a dicarboxylic acid having the structure

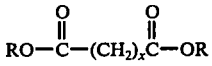

wherein $x$ is 2 to 22 and R is an alkyl radical containing 2 to 22 carbon atoms; and 3. about 4 weight percent of an ethoxylated ester of the formula

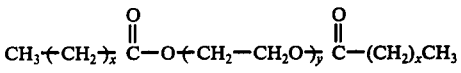

wherein $x$ is 4 to 22 and $y$ is 1 to 40;

b. about 20 weight percent of an ethoxylated fatty acid wax which has a melting point greater than 100° F. and having the formula

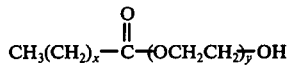

wherein $x$ is 10 to 22 and $y$ is 5 to 200;

c. about 15 weight percent of a mixture of 1. about 6 weight percent of an alkali metal salt of a phosphoric acid mono- or diester of an ethylene oxide adduct of at least one member selected from the group consisting of a $C_8$ to $C_{18}$ linear alkyl alcohol which contains 2 to 25 moles of ethylene oxide; and 2. about 9 weight percent of an alkali metal salt of sulfated fatty alcohols containing 12 to 22 carbon atoms; and d. about 35 weight percent of a mixture of blending agents comprising 1. about 9 weight percent of an ethoxylated alcohol having the formula $$CH_3(CH_2)_x(OCH_2CH_2)_n—OH$$

wherein $x$ is from 8 to 22 and $n$ is 1 to 20;

2. about 4 weight percent of an ethoxylated castor oil ether containing from about 5 to about 200 moles of ethylene oxide per mole of castor oil;

3. about 11 weight percent of an ethoxylated polyoxypropylene having the formula $$H(OCH_2CH_2)_x O\left(CH(CH_3)—CH_2—O\right)_y (CH_2CH_2—O)_z H$$

wherein $x$ is 1 to 15, $y$ is 1 to 50, and $z$ is 1 to 15;

4. about 8 weight percent of an ethoxylated aromatic phenol ether having the formula

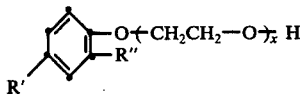

wherein R′ and R″ are aryl, substituted aryl, alkyl aryl, alkyl substituted aryl, and $x$ is 1 to 25; and 5. about 4 weight percent of an aliphatic saturated or unsaturated alcohol containing 10 to 30 carbon atoms.

5. Continuous filament textile yarn comprising a partially oriented polyester fiber having on the surface thereof a textile treating composition which comprises:

a. about 30 weight percent of a blend containing 1. about 19.1 weight percent of an alkylidyne trimethanol ester having the formula

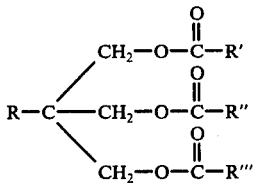

wherein R is H or an alkyl radical having 1 to 12 carbon atoms and R′, R″, and R‴ are selected from the class consisting of saturated alkyl and alkenyl radicals containing from 4 to 14 carbon atoms per radical;

2. about 6.9 weight percent of a diester of a dicarboxylic acid having the structure

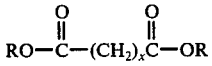

wherein $x$ is 2 to 22 and R is an alkyl radical containing 2 to 22 carbon atoms; and 3. about 3.8 weight percent of an ethoxylated ester of the formula

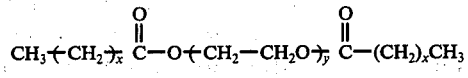

wherein $x$ is 4 to 22 and $y$ is 1 to 40;

b. about 20 weight percent of an ethoxylated fatty acid wax which has a melting point greater than 100° F. and having the formula

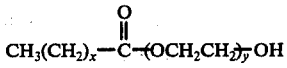

wherein $x$ is 10 to 22 and $y$ is 200;

c. about 15 weight percent of at least one processing aid selected from the group consisting of 1. 5.4 weight percent of an alkali metal salt of a phosphoric acid mono- or diester of an ethylene oxide adduct of at least one member selected from the group consisting of a $C_8$ to $C_{18}$ linear alkyl alcohol which contains 2 to 25 moles of ethylene oxide; and 2. 9.1 weight percent of an alkali metal salt of sulfated fatty alcohols containing 12 to 22 carbon atoms; and d. about 35 weight percent of at least one blending agent of the group consisting of 1. 9.1 weight percent of an ethoxylated alcohol having the formula $$CH_3(CH_2)_xOCH_2CH_2)_n—OH$$

wherein $x$ is from 8 to 22 and $n$ is 1 to 20;

2. 3.8 weight percent of an ethoxylated castor oil ether containing from about 5 to about 200 moles of ethylene oxide per mole of castor oil;

3. 11.4 weight percent of an ethoxylated polyoxypropylene having the formula $$H(OCH_2CH_2)_x O\left(CH(CH_3)—CH_2—O\right)_y (CH_2CH_2—O)_z H$$

wherein $x$ is 1 to 15, $y$ is 1 to 50, and $z$ is 1 to 15;

4. 7.6 weight percent of an ethoxylated aromatic phenol ether having the formula

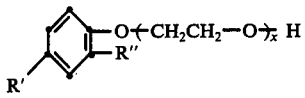

wherein R′ and R″ are aryl, substituted aryl, alkyl, alkyl substituted aryl, and $x$ is 1 to 25; and 5. 3.8 weight percent of an aliphatic saturated or unsaturated alcohol containing 10 to 30 carbon atoms.

6. Continuous filament yarn according to claim 5 wherein said alkylidyne trimethanol ester is a triester of propylidyne trimethanol and $C_8$–$C_{10}$ saturated aliphatic carboxylic acid.

7. Continuous filament yarn according to claim 6 wherein said diester of a dicarboxylic acid is dioctyl sebacate.

8. Continous filament yarn according to claim 2 wherein said ethoxylate ester is polyethylene glycol dilaurate having a molecular weight of about 300.

9. Continuous filament yarn according to claim 8 wherein said wax is ethoxylated stearate containing about 40 moles of ethylene oxide per mole of stearyl alcohol.

10. Continuous filament yarn according to claim 9 wherein said alkali metal salt of a phosphoric acid mono- or diester of an ethylene oxide adduct of a linear alkyl alcohol is an ethoxylated lauryl potassium phosphate containing about 5 moles of ethylene oxide per mole of lauryl potassium phosphate.

11. Continuous filament yarn according to claim 10 wherein said alkali metal salt of a sulfated fatty alcohol is sodium lauryl sulfate.

12. Continuous filament yarn according to claim 11 wherein said ethoxylated alcohol is ethoxylated stearyl ether containing about 5 moles of ethylene oxide per mole of stearyl alcohol.

13. continuous filament yarn according to claim 12 wherein said ethoxylated castor oil contains about 30 moles of ethylene oxide per mole of castor oil.

14. Continuous filament yarn according to claim 13 wherein said ethoxylated polyoxypropylene is an ethoxylated polyoxypropylene containing about one mole of ethylene oxide per 3 moles propylene oxide.

15. Continuous filament yarn according to claim 14 wherein said ethoxylated aromatic phenol ether is ethoxylated benzyl phenyl phenol ether containing about 6 moles of ethylene oxide per mole of benzyl phenyl phenol.

16. Continuous filament yarn according to claim 15 wherein said aliphatic unsaturated alcohol is oleyl alcohol.

* * * * *

UNITED STATES PATENT OFFICE
CERTIFICATE OF CORRECTION

Patent No. 4,039,715 Dated August 2, 1977

Inventor(s) Bobby C. Carver

It is certified that error appears in the above-identified patent and that said Letters Patent are hereby corrected as shown below:

Column 10, line 45, the formula should read $$CH_3\{CH_2\}_x\{OCH_2CH_2\}_n-OH$$

Column 14, line 54, after the word "alkyl" and before the comma (,) add the word ---aryl---.

Column 14, line 66, "claim 2" should read ---claim 7---.

Column 14, line 67, "ethoxylate" should read ---ethoxylated---.

Column 16, line 3, "continuous" should read ---Continuous---.

Signed and Sealed this

Fourth Day of April 1978

[SEAL]

Attest:

RUTH C. MASON
Attesting Officer

LUTRELLE F. PARKER
Acting Commissioner of Patents and Trademarks